US007806682B2

(12) United States Patent
Cueva

(10) Patent No.: US 7,806,682 B2
(45) Date of Patent: Oct. 5, 2010

(54) LOW CONTAMINATION RATE FLAME DETECTION ARRANGEMENT

(75) Inventor: Victor J. Cueva, New Hope, MN (US)

(73) Assignee: Honeywell International Inc., Morristown, NJ (US)

( * ) Notice: Subject to any disclaimer, the term of this patent is extended or adjusted under 35 U.S.C. 154(b) by 1264 days.

(21) Appl. No.: 11/276,231

(22) Filed: Feb. 20, 2006

(65) Prior Publication Data

US 2007/0207422 A1 Sep. 6, 2007

(51) Int. Cl.
*F23N 5/00* (2006.01)

(52) U.S. Cl. ..... 431/75; 431/78; 431/14

(58) Field of Classification Search ..... 431/75, 431/78, 86, 69, 13, 14, 15; 340/577, 578, 340/579

See application file for complete search history.

(56) References Cited

U.S. PATENT DOCUMENTS

| | | | | |
|---|---|---|---|---|
| 3,909,816 | A | | 9/1975 | Teeters |
| 4,157,506 | A | | 6/1979 | Spencer |
| 4,221,557 | A | | 9/1980 | Jalics |
| 4,303,385 | A | * | 12/1981 | Rudich et al. ..... 431/70 |
| 4,483,672 | A | | 11/1984 | Wallace et al. |
| 4,655,705 | A | | 4/1987 | Shute et al. |
| 4,695,246 | A | | 9/1987 | Beilfuss et al. |
| 4,830,601 | A | | 5/1989 | Dahlander et al. |
| 4,842,510 | A | | 6/1989 | Grunden et al. |
| 4,872,828 | A | | 10/1989 | Mierzwinski |
| 4,955,806 | A | | 9/1990 | Grunden et al. |
| 5,037,291 | A | | 8/1991 | Clark |
| 5,077,550 | A | | 12/1991 | Cormier |
| 5,112,117 | A | | 5/1992 | Ripka et al. |
| 5,126,721 | A | | 6/1992 | Butcher et al. |
| 5,158,477 | A | | 10/1992 | Geary |
| 5,175,439 | A | | 12/1992 | Harer et al. |
| 5,222,888 | A | | 6/1993 | Jones et al. |
| 5,236,328 | A | | 8/1993 | Tate et al. |
| 5,255,179 | A | | 10/1993 | Zekan et al. |
| 5,280,802 | A | | 1/1994 | Comuzie, Jr. |
| 5,347,982 | A | | 9/1994 | Binzer et al. |
| 5,391,074 | A | | 2/1995 | Meeker |
| 5,424,554 | A | | 6/1995 | Marran et al. |

(Continued)

FOREIGN PATENT DOCUMENTS

EP 0967440 12/1999

(Continued)

OTHER PUBLICATIONS www.playhookey.com, "Series LC Circuits," 5 pages, printed Jun. 15, 2007.

(Continued)

*Primary Examiner*—Alfred Basichas
(74) *Attorney, Agent, or Firm*—Crompton Seager & Tufte LLC

(57) ABSTRACT

Contamination rate reduction for a flame detection or sensor arrangement using controlled but flexible flame sensor activation. A flame sensor of the subject application is subject to contamination which reduces the lifetime of the sensor. To reduce a contamination rate of the flame sensor, the sensor may be inactivated for certain periods of time when the necessity of flame detection does not appear significant for the use at hand.

21 Claims, 3 Drawing Sheets

U.S. PATENT DOCUMENTS

| | | | | |
|---|---|---|---|---|
| 5,506,569 | A | | 4/1996 | Rowlette |
| 5,567,143 | A | | 10/1996 | Servidio |
| 5,797,358 | A | | 8/1998 | Brandt et al. |
| 5,971,745 | A | | 10/1999 | Bassett et al. |
| 6,060,719 | A | | 5/2000 | DiTucci et al. |
| 6,084,518 | A | | 7/2000 | Jamieson |
| 6,126,435 | A | * | 10/2000 | Fredin-Garcia et al. ..... 431/14 |
| 6,222,719 | B1 | | 4/2001 | Kadah |
| 6,299,433 | B1 | | 10/2001 | Gauba et al. |
| 6,509,838 | B1 | | 1/2003 | Payne et al. |
| 6,743,010 | B2 | | 6/2004 | Bridgeman et al. |
| 6,794,771 | B2 | | 9/2004 | Orloff |
| 2002/0099474 | A1 | | 7/2002 | Khesin |
| 2003/0064335 | A1 | | 4/2003 | Canon |
| 2004/0209209 | A1 | | 10/2004 | Chodacki et al. |

FOREIGN PATENT DOCUMENTS

| | | |
|---|---|---|
| EP | 1148298 | 10/2001 |
| WO | 9718417 | 5/1997 |

OTHER PUBLICATIONS

Honeywell, "S4965 Series Combined Valve and Boiler Control Systems," 16 pages, prior to the filing date of present application.

Honeywell, "SV9410/SV9420; SV9510/SV9520; SV9610/SV9620 SmartValve System Controls," Installation Instructions, 16 pages, 2003.

* cited by examiner

LOW CONTAMINATION RATE FLAME DETECTION ARRANGEMENT

BACKGROUND

This invention pertains to combustion system flame sensors, and particularly to flame sensor circuits. More particularly, the invention pertains to sensor contamination.

This invention may be related to U.S. patent application Ser. No. 10/908,463, filed May 12, 2005; U.S. patent application Ser. No. 10/908,465, filed May 12, 2005; U.S. patent application Ser. No. 10/908,466, filed May 12, 2005; and U.S. patent application Ser. No. 10/908,467, filed May 12, 2005. These applications have the same assignee as the present application.

U.S. patent application Ser. No. 10/908,463, filed May 12, 2005; U.S. patent application Ser. No. 10/908,465, filed May 12, 2005; U.S. patent application Ser. No. 10/908,466, filed May 12, 2005; and U.S. patent application Ser. No. 10/908,467, filed May 12, 2005, are hereby incorporated by reference.

SUMMARY

This invention is an arrangement and approach for reducing a contamination rate in a flame sensor.

DESCRIPTION

Figure 1:
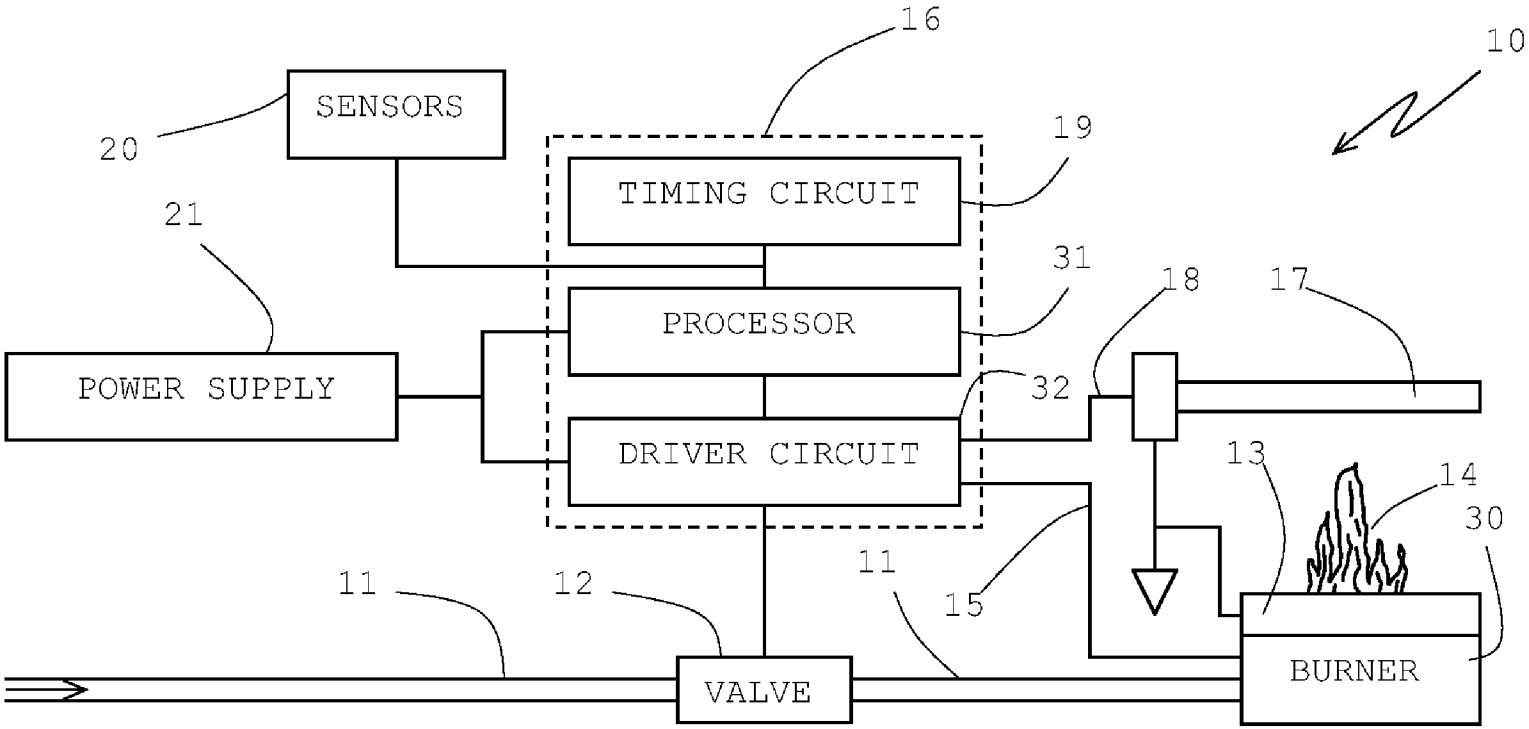
FIG. 1 shows a flame detection or sensing arrangement.

Flame rectification type flame sensing arrangements may be subject to continuing performance deterioration due to a build up of contaminants on a flame sensing rod and flame ground area, i.e., proximate to a burner. Over time in the field, the build up may cause intermittent operation or failure of an appliance (e.g., heating unit). Often this problem is not appropriately diagnosed, thus in some cases resulting in repeated service calls and poor customer satisfaction with a system incorporating the flame sensing arrangement.

In rectification type flame sensors, as noted here, contaminants may accumulate due to ion attraction to an electrically charged flame sensing rod and ground area. When the sensing rod is not energized, contamination rates drop dramatically as the contaminants are not as highly attracted to the rod. However, there still is a continuation of some contamination of the rod. Other flame sensors appear to continuously monitor for a flame during both the normal burner "on" and "off" cycles. Monitoring during the off cycle is considered necessary to detect a flame out of sequence (e.g., a leaky or faulty gas valve). A flame out of sequence may be a rare occurrence, but it needs to be detected when it ever occurs. Thus, various systems maintain energized flame sensing rods whenever the heating unit or appliance is powered. This invention may reduce overall flame sensing rod contamination rates in the field by cycling the flame voltage on and off during a heating off cycle. For example, if a flame voltage (in the off cycle) is imposed in one out of four seconds (i.e., 25 percent duty cycle) rather than continuously, then the rate of flame sensing rod contamination may be significantly reduced. Different duty cycle or time combinations may be used. Reduced duty cycles for flame sensing rod energization may result in a much longer field life of the flame sensor before sensing rod contamination starts to impact performance.

A flame out of sequence could occur while a burner cycle is ending (i.e., a gas valve does not close properly as expected). The present arrangement may be implemented by maintaining a normal flame sense voltage for a period of time (e.g., 30 seconds or so) after the gas valve is turned off. This approach should detect a problem due to a gas valve failure to immediately close. If no problem is detected during this time period, then a controller may move to the cycling flame voltage sequence of on and off for a reduction of flame sensing rod contamination rates during the rest of the heating off cycle.

The flame sensor may be on or off while a heating unit or appliance is on. The burner may be on or off while the unit or appliance is on. The sensor may be activated and deactivated for various periods of time while the burner is on and also while it is off. The burner may be a component of the heating unit or appliance. If the heating unit or appliance incorporating a burner is off, then the associated components may be regarded as being effectively off. The heating unit or appliance may be regarded as a part of a larger system (e.g., an HVAC).

FIG. 1 shows a block diagram of an illustrative example of a flame detector control arrangement 10. Gas or other fuel may be provided through a conveyance or pipe 11 through a valve 12 to a burner 30 having a flame ground area 13. Valve 12 may be closed to prevent the flow of gas to the burner 30 and thus extinguish the flame 14. If the valve 12 is opened, then fuel or gas may be provided to the burner 30. Valve 12 control may be provided by a signal along a conductor from a controller 16 having a processor 31, driver circuit 32 and timing circuit 19. Processor 31 may be connected to temperature and other types of sensors 20. A power supply 21, for providing power to the arrangement, may be connected to the processor 31 and driver circuit 32 of controller 16. Power to the timing circuit 19 and sensors 20 may be controlled and forwarded by the processor 31 from the power supply 21.

A spark mechanism in the burner 30 may ignite the gas to bring about the flame 14. The spark mechanism may receive a sufficient voltage along a conductor 15 from the driver circuit 32. The flame 14 may be detected by an energized flame sensing rod 17. If the sensing rod 17 is not energized, it may be energized by a voltage via a conductor 18 from the driver circuit 32. The timing circuit 19 of controller 16 may provide various patterns for turning on and off the flame sensing rod or flame sensor 17 voltage, along with controlling valve 12.

FIGS. 2*a*, 2*b*, 2*c* and 2*d* provide several illustrative examples of timing of the flame sensor or sensing rod 17 energizing together with the timing of gas valve 12 opening and closure, and the presence of flame 14. The timing signals are of the flame sensing rod 17, flame 14, and gas valve 12, which are designated with reference numerals 27, 24 and 22, respectively. The existence of the flame 14 may be assumed independently of detection by the flame sensing rod 17 for illustrative purposes. The timing graphs have "H" and "L" (e.g., high and low) level indications. "H" indicates that flame sensing rod 17 is energized according to the flame sensing rod timing signal 27. "L" indicates that flame sensing rod 17 is not energized according to the flame sensing rod timing signal 27. Similarly, "H" and "L" indicate that the flame 14 is present and not present, respectively, according to the flame timing signal 24. Likewise, "H" and "L" indicate that the valve 12 is open and closed, respectively, according to the valve timing signal 22.

Figure 2A:
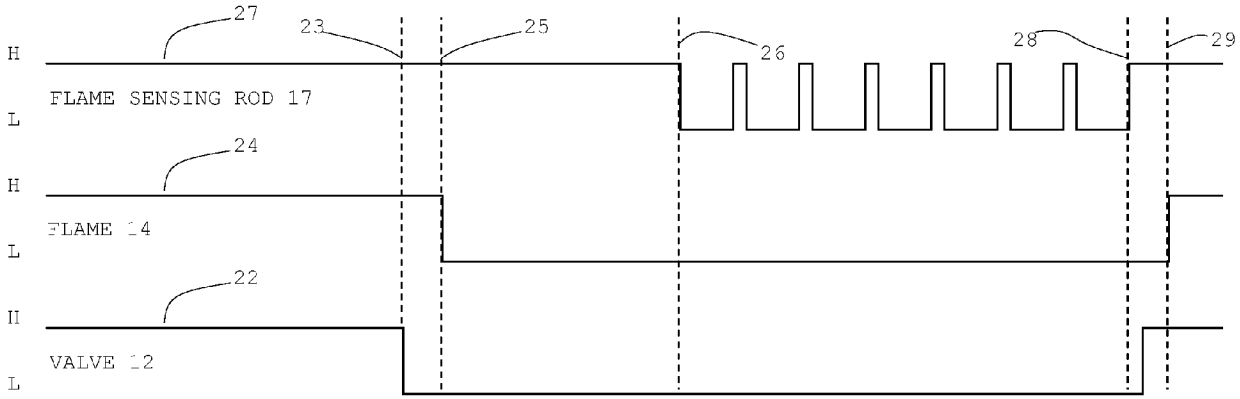
FIGS. 2*a*, 2*b*, 2*c* and 2*d* are various timing diagrams of the flame sensor, flame and valve activity.

In FIG. 2*a*, the gas valve 12 is indicated as "on" at the left portion of the valve timing signal 22. Also, the flame sensing rod 17 is energized according to the timing signal 27 and the flame 14 is present according to timing signal 24. One may note that the flame 14 presence may continue briefly according to signal 24 after gas valve 12 is closed at time line 23 according to signal 22 at that time. The flame presence 14 may continue for an additional period of time up to time line 25 according to timing signal 24, possibly due to remaining gas in the pipe 11 between the valve 12 and the burner 30, or due to a slow closure of valve 12. The flame 14 may stay on if the valve 12 is stuck open, and likewise flame sensor 17 will remain on as long as the flame 14 is sensed by the flame sensor 17. The flame sensor or sensing rod 17 may purposely remain energized, even if valve 12 is appropriately closed, for a period as indicated by signal 27 up to at least time line 26. Such period of time may be 15, 30 or more or less seconds.

After the time line 26, which is an "burner off" cycle, assuming the flame 14 to be extinguished, the arrangement may energize the flame sensing rod 17 just periodically (rather than continually) for flame detection to reduce rod contamination. For an illustrative example, the energization signal 27 for the flame sensing rod may have a 25 percent duty cycle, i.e., the sensing rod 17 may be energized for one second, deenergized for three seconds, periodically, until the gas valve 12 is turned on as indicated by signal 22 at a time line 28. The duty cycle may be some other percentage as appropriate for reliable monitoring of the burner 30. The flame 14 may ignite at time line 29.

Figure 2B:
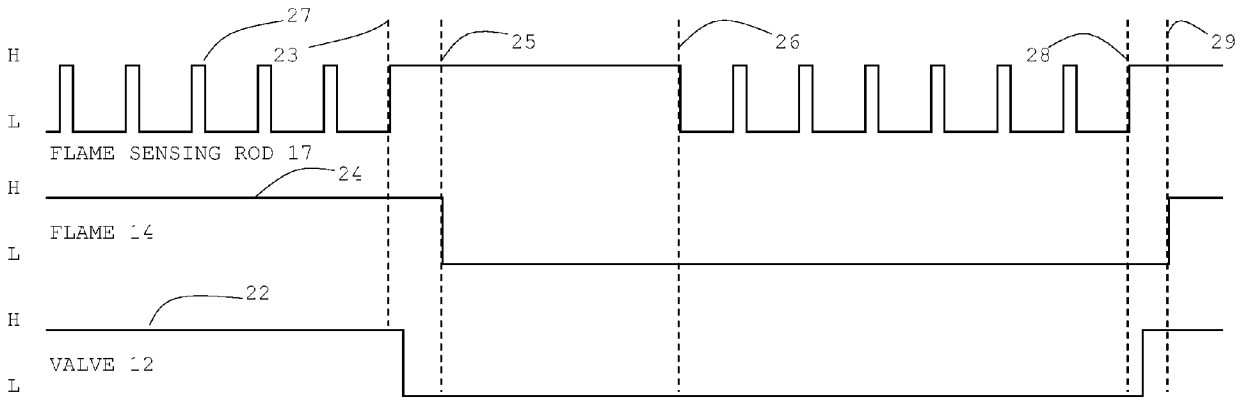

FIG. 2*b* shows another example of timing of the flame sensing rod 17 energization signal 27 relative to the flame 14 indication signal 24 and gas valve 12 activation signal 22. A significant difference between this diagram and that of FIG. 1*a*, is that during the "burner on" period up to the time line 23, the flame sensing rod 17 energization signal 27 may have a duty cycle, such as 25 percent, where it is energized for a period of time and then deenergized for another period of time in a periodic fashion, to reduce the rate of contamination of the flame sensing rod 17. However, as in FIG. 2*a*, the sensing rod 17 energization signal 27 may remain on continually for a period of time after the gas valve 12 closure. Various other patterns of timing signals may be implemented for an arrangement or system. Also, such timing may be non-periodic.

Figure 2C:
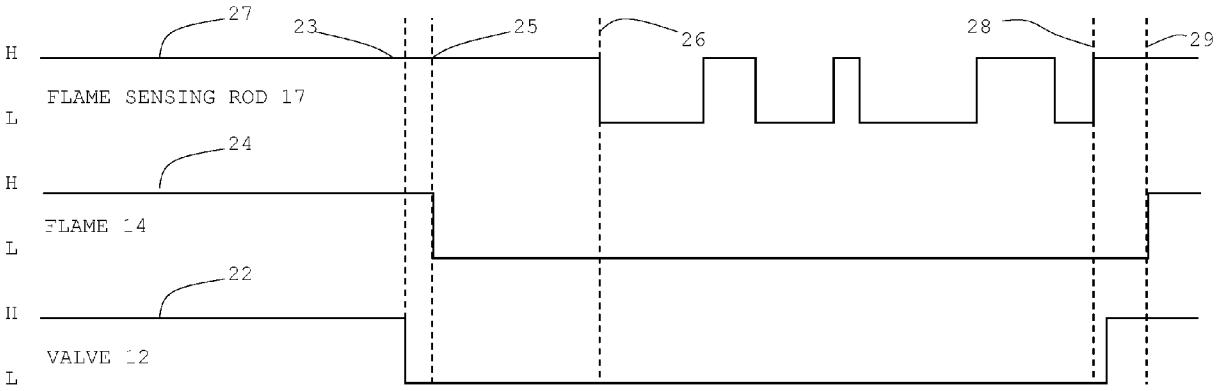
Figure 2D:
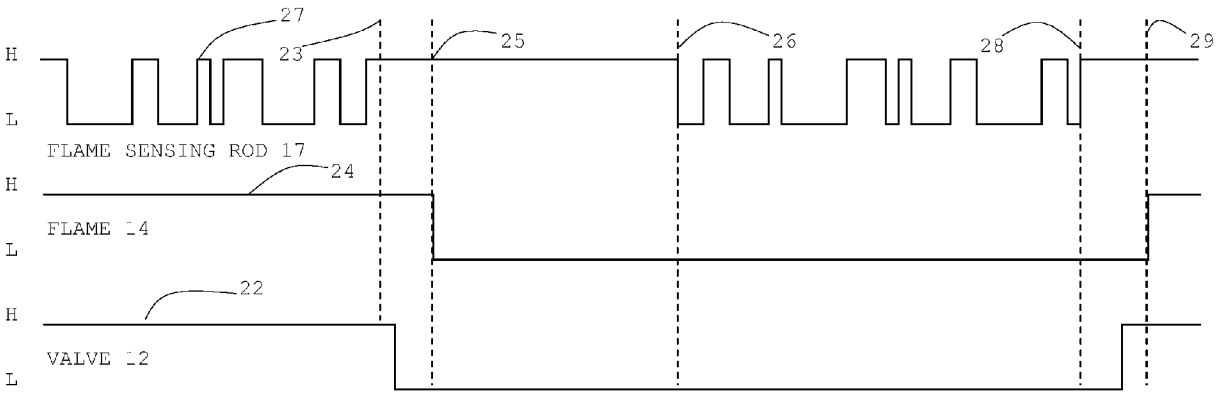

FIGS. 2*c* and 2*d* show other illustrative examples of timing diagrams of flame sensing rod 17 energization signals 27 that might not have consistent, regular, or periodic patterns. The deenerization and energization of the flame sensing rod 17 may be indicated by timing circuit 19 signals via controller 16 that may provide a good timing profile of signal 27 in view of other parameters, such as those noted by sensors 20, from or to the flame detector control arrangement 10. The signal 27 profile may be dynamic in pattern. Also, the time lines 23, 25, 26, 28 and 29 may be shifted or be dynamically shifting from time to time in accordance with signals of the controller 16 for one reason or another. There may be various combinations of timing diagrams in a sensing arrangement or system.

A need or an estimated need for flame sensing may be a basis for a timing pattern for energization of the flame sensor 17. Such timing pattern could be but would not necessarily be regular or periodic. Controller 16 may control the energization or activation of the flame sensor 17 with approaches that indicate the times when to activate and inactivate the flame sensor 17 in order to maximize the monitoring of the burner 30 and its flame 14, if there is a flame, and minimize the contamination rate of the sensor 17, in conjunction with a number of variables and fixed parameters. Some of the flame sensor energization and deenergization timing techniques involving variables and parameters for controlling the flame sensor 17, valve 12 and burner 30, incorporated in controller 16, may include model predictive control (MPC) and optimization, proportional-integral-derivative (PID) tuning and control, fuzzy logic control, neural network control, and the like. Examples of applications, arrangements or systems related to the control strategy of controller 16 applicable to flame sensor 17 activation and inactivation, relative to burner 30 flame 14 status, may be based on principles and concepts disclosed in U.S patent application Ser. No. 11/014,336, filed Dec. 16, 2004; U.S. Pat. No. 5,351,184, issued Sep. 27, 1994; U.S. Pat. No. 5,561,599, issued Oct. 1, 1996; U.S. Pat. No. 5,574,638, issued Nov. 12, 1996; U.S. Pat. No. 5,572,420, issued Nov. 5, 1996; U.S. Pat. No. 5,758,047, issued May 26, 1998; U.S. Pat. No. 6,122,555, issued Sep. 19, 2000; U.S. Pat. No. 6,055,483, issued Apr. 25, 2000; U.S. Pat. No. 6,253,113, issued Jun. 26, 2001; U.S. Pat. No. 6,542,782, issued Apr. 1, 2003; and U.S. patent application Ser. No. 11/323,280, filed Dec. 30, 2005; all of which are hereby incorporated by reference. These patents and applications are assigned to the assignee of the present invention.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A flame sensor system comprising:

a burner for a heating unit;

a flame sensor proximate to the burner; and a controller connected to the burner and the flame sensor; and wherein during operation of the system, the controller is configured to periodically and repeatedly activate and deactivate the flame sensor while the heating unit is in operation, whether the burner has a flame or not.

2. The system of claim 1, wherein during operation of the system, the flame sensor is configured to be activated and deactivated periodically while the burner has no flame.

3. The system of claim 2, further comprising:

a valve for controlling fuel to the burner; and wherein during operation of the system:

shortly after the valve is opened the burner should have a flame;

shortly after the valve is closed the burner should not have a flame;

after the valve is closed, the burner may have a flame for a brief time to burn residual fuel; and after the valve is closed, the burner may continue to have a flame due to a faulty valve.

4. The system of claim 3, wherein during operation of the system, after the valve is closed, the controller is configured to activate the flame sensor for at least a short period of time.

5. The system of claim 4, wherein after the flame sensor is activated for the short period of time:

while the valve remains closed and the heating unit is in operation, the flame sensor has an X percent duty cycle;

the X percent duty cycle means that the flame sensor is activated for X percent of a certain period and is deactivated for (100−X) percent of the certain period.

6. The system of claim 4, wherein:

while the valve is open and the heating unit is in operation, the flame sensor has a Y percent duty cycle;

the Y percent duty cycle means that the flame sensor is activated for Y percent of a certain period and is deactivated for (100−Y) percent of the certain period.

7. A method for reducing a contamination rate of a flame sensor for detecting a flame of a burner, comprising:

controlling an activation of a flame sensor to a minimum amount of time needed for adequate flame sensing;

wherein said controlling includes periodically and repeatedly activating and deactivating said flame sensor during operation of the burner whether or not the burner has a flame, and wherein a minimum amount of time of activation of the flame sensor may result in a minimum amount of contamination of the flame sensor.

8. The method of claim 7, wherein the flame sensor is periodically activated and deactivated when the burner has no flame.

9. The method of claim 8, wherein the flame sensor is activated for one period of time when not proximate to a flame and inactivated for another period of time when not proximate to a flame.

10. The method of claim 8, wherein the flame sensor is activated for one period of time when proximate to a flame and inactivated for another period of time when proximate to a flame.

11. A flame sensor system comprising:

a burner;

a flame sensor proximate to the burner;

a controller connected to the flame sensor; and wherein the controller activates the flame sensor for a first period of time and then deactivates the flame sensor for a second period of time, wherein the controller activates and deactivates the flame sensor regardless of whether the burner has a flame or does not have a flame, wherein the controller activates and deactivates the flame sensor repeatedly in sequence.

12. The system of claim 11, wherein:

the flame sensor is activated for a minimum amount time needed for adequate sensing of a flame; and wherein a minimum amount of activation of the flame sensor may result in a minimum amount of contamination of the flame sensor.

13. The system of claim 11, wherein the flame sensor is activated for the first period of time when not proximate to a flame and deactivated for the second period of time when not proximate to a flame.

14. The system of claim 13, wherein the first period of time and the second period of time occur in sequence in a repeated manner for a certain length of time.

15. The system of claim 14, wherein:

the first period of time does not necessarily have the same duration when repeated in the sequence; and the second period of time does not necessarily have the same duration when repeated in the sequence.

16. The system of claim 11, wherein the flame sensor is activated for the first period of time when proximate to a flame and deactivated for the second period of time when proximate to a flame.

17. The system of claim 16, wherein, for the flame sensor proximate to a flame, the first period of time and the second period of time occur in sequence in a repeated manner for a certain length of time.

18. The system of claim 17, wherein:

the first period of time does not necessarily have the same duration when repeated in the sequence; and the second period of time does not necessarily have the same duration when repeated in the sequence.

19. The system of claim 11, wherein the controller determines the certain times according to model predictive control, proportional-integral-derivative control, fuzzy logic control, or neural network control.

20. The system of claim 11, wherein:

if the flame sensor accumulates contamination at a first rate when activated and not proximate to a flame, and the flame sensor accumulates contamination at a second rate when inactivated and not proximate to a flame, then the first rate may be greater than the second rate; and if the flame sensor accumulates contamination at a third rate when activated and proximate to a flame, and the flame sensor accumulates contamination at a fourth rate when inactivated and proximate to a flame, then the third rate may be greater than the fourth rate.

21. The system of claim 20, wherein the controller adjusts the first and second time periods to achieve a smaller contamination rate, which may lead to a longer life of sensing by the flame sensor.

* * * * *